US005183449A

United States Patent [19]

DeCloux

[11] Patent Number: 5,183,449

[45] Date of Patent: Feb. 2, 1993

[54] DIE CAST SYSTEM FOR CONTROL OF STAIRCLIMBING EXERCISE DEVICE

[76] Inventor: Richard J. DeCloux, 1485 Belmont St., Manchester, N.H. 03104

[21] Appl. No.: 592,205

[22] Filed: Oct. 3, 1990

[51] Int. Cl.[5] ..... A63B 23/06

[52] U.S. Cl. ..... 482/53; 482/112

[58] Field of Search ..... 272/69, 70, 71, 130, 272/DIG. 1, 134, 96, 97; 128/25 R

[56] References Cited

U.S. PATENT DOCUMENTS 3,758,112 9/1973 Crum et al. ..... 272/130

4,934,690 6/1990 Bull ..... 272/130

FOREIGN PATENT DOCUMENTS 0135346 of 1985 European Pat. Off. ..... 272/130

*Primary Examiner*—Richard J. Apley

*Assistant Examiner*—Jerome Donnelly

*Attorney, Agent, or Firm*—Robert K. Tendler

[57] ABSTRACT

A unitized assembly for control of ram-actuated stair climbing type exercise equipment provides rigidly connected ram cylinders in a unitary structure which includes a pair of castings, in which the castings eliminate the necessity of individually mounting discrete ram cylinders while at the same time eliminating the necessity for over 20 parts as compared to piston type hydraulic systems assembled from discrete components. The top casting accommodates two rams, one for each pivoted stair step. The bottom casting includes two chambers and the passageways that connect them with the rate valve that controls exercise speed. The passageways also connect to the fluid volume valve which controls step height and lost fluid replacement. As a feature for pivoted arm machines, the tops of the rams are not pivotally attached to the stair step arms, but rather contact rollers on the arms so that the rams and associated housings need not swivel with movement of the arms during exercise. This permits the rigid connection between the ram cylinders provided by the unitary pair of castings. Moreover, an integral heat exchanger is provided, along with ports for both a rate control valve and a fluid volume valve, with the fluid volume valve and an auxiliary cylinder providing selective step height control and makeup of lost fluid. As another further feature, the rams have a larger diameter on one end to retain them in the structure.

16 Claims, 7 Drawing Sheets

DIE CAST SYSTEM FOR CONTROL OF STAIRCLIMBING EXERCISE DEVICE

FIELD OF INVENTION

This invention relates to stair-type aerobic exercise equipment and more particularly to a unitized assembly including a pair of die castings which simplifies the construction of such equipment.

BACKGROUND OF THE INVENTION

Hydraulic exercise machines such as illustrated in U.S. Pat. Nos. 4,496,147; 4,480,832; 4,465,274; 4,363,481; 4,063,726; 3,702,188; 3,606,318; 3,530,766; 3,529,474; 3,128,094; and 2,079,594 have found favor because of the reliability inherent in hydraulic energy absorption systems. Especially with respect to exercise stairs, three kinds of hydraulic stair systems have evolved. First, piston cylinder systems have been provided that offer hydraulic step height adjustment through a hydraulic bypass system described in U.S. Pat. No. 4,681,316. Secondly, hydraulic shock absorber based systems are used that are less expensive than piston cylinder systems but offer no step height adjustment, rate control, or the long life features of the piston cylinder systems. Thirdly, ram cylinder systems provide the cost advantages of the shock absorber base systems, and offer the rate control of the piston cylinder systems, but provide no step height adjustment.

By way of definition, hydraulic piston cylinder systems utilize a plug, called a piston, that moves within the cylinder when fluid under pressure is introduced into one end of the cylinder. The universal aspect of a piston is that it seals to the inside walls of a cylinder. As a result, the piston divides a cylinder into two distinct, isolated chambers. A piston rod is normally attached to the piston and extends through one of the two closed ends of the cylinder.

Hydraulic ram cylinders are differentiated from piston cylinders by the absence of a piston. As a result, there is but one chamber associated with the system. A portion of the rod or ram extends into the chamber, and its end provides a surface for the fluid to push against. When fluid is introduced into this chamber, the ram is forced out of the cylinder. Rams can only push; they cannot pull.

Such a ram cylinder system is described in U.S. Pat. No. 4,496,147, issued to Richard J. DeCloux in which steps are phased relative one to the other by the ram cylinder system. Here fluid goes from one ram cylinder to another through a valve which controls the rate of exercise. In one embodiment the steps are attached to pivoted lever arms with linkages between the arms coupled to respective rams. This system, while providing a useful exercise device is not provided with a simple way of adjusting step height.

In U.S. patent application No. 462,835, filed Jan. 10, 1990 by Richard J. DeCloux and incorporated herein by reference, an auxiliary cylinder provides fluid to a ram cylinder system, or removes fluid from the system to adjust the step height. The auxiliary cylinder in one embodiment has a ram which is moved into and out of the cylinder to add or subtract fluid for step height adjustment.

Step height adjustment is in fact important with respect to the comfort of the exercise routine, and it is for this reason that the aforementioned U.S. Pat. No. 4,681,316 was provided with a hydraulic bypass system.

However in the implementation of such a piston-type bypass system, as many as twenty separate parts were proven to be necessary in order to implement step phasing and adjustment, rate control, and heat dissipation for a stair climber-type exercise. The result is not only cost and complexity, but also the number of individual separate parts provides avenues for failure. Moreover since each of the pistons was pivotally attached to an arm of the device, all pistons and cylinders had to be flexibly mounted so they could move during exercise.

SUMMARY OF THE INVENTION

As opposed to piston systems, in order to accommodate step height regulation while at the same time providing control of exercise rate and heat dissipation for the simpler and more reliable ram cylinder control system, a unitized assembly including two castings is utilized in which the bottom casting includes two spaced-apart ram cylinder chambers, with fluid channeling from one to the other through a first channel into which a rate control valve is interposed. A second channel communicates with the first channel and an auxiliary cylinder which provides a reservoir of oil to the system through the port to which the auxiliary cylinder is coupled. The auxiliary cylinder may be of the ram type described above, or may simply be a gravity-type accumulator, with the auxiliary cylinder adjusting step height by use of a piston to selectively add to or subtract from the total volume of fluid in the ram cylinder chambers. Alternatively, the auxiliary cylinder may use compressed air above the oil to force additional oil into the system. In order to accomplish this, a fluid volume control valve is interposed in the second channel and is opened. After the appropriate amount of fluid is introduced into the system, the valve is closed, thereby to prevent a springy type of feeling for the exercise equipment. Thus, in one embodiment the auxiliary cylinder may be connected to the operating system by a valve which when shut, locks in place the amount of fluid in the system. Upon opening of this valve, oil can be added to the operating system by pressurized air in the auxiliary cylinder. Oil is subtracted by stepping on one of the steps which depresses the corresponding ram to force oil back into the auxiliary cylinder.

In between the two ram-receiving chambers is an integral heat exchanger which dissipates the heat that accumulates during exercise, with the heat exchanger fins projecting downwardly inbetween the two ram-receiving chambers.

The hydraulic rams are each provided with face plates which prevent the rams from exiting the housing during an upstroke. The first channel is chamferred to accommodate the extra width of the face plates on the rams such that the plates do not occlude the first channel when the associated ram is in an up position.

In summary, a unitized ram system for stair climbing type exercise equipment includes a pair of castings, in which the configuration of the castings eliminates the necessity for over 20 parts as compared to piston type hydraulic systems assembled from discreet components. The use of the unitary structure in combination with the ram cylinder system and the fluid volume valve minimizes the number of parts necessary for the control of pivoted arm-type exercise equipment, thus greatly reducing parts count and cost. The unitized system provides step height adjustment, minimizes thermal impact on step height, and provides a vehicle for replacement of system fluid loss. The top casting accommodates two rams, one for each pivoted stair step. The bottom casting includes two chambers and the passageways that connect them with the rate valve that controls exercise speed. The passageways also connect to the fluid volume valve which controls step height and lost fluid replacement. As a feature, for pivoted arm machines the tops of the rams are not pivotally attached to the stair step arms, but rather contact rollers on the arms so that the rams and associated housings need not swivel with movement of the arms during exercise. Moreover, an integral heat exchanger is provided, along with ports for both a rate control valve and a fluid volume valve, with the fluid volume valve and an auxiliary cylinder providing selective step height control and makeup of lost fluid. As a further feature, the rams have a larger diameter on one end to retain them in the structure.

BRIEF DESCRIPTION OF THE DRAWINGS

These and other features of the Subject invention will be better understood in conjunction with the Detailed Description taken in conjunction with the Drawings of which.

DETAILED DESCRIPTION

Figure 1A:
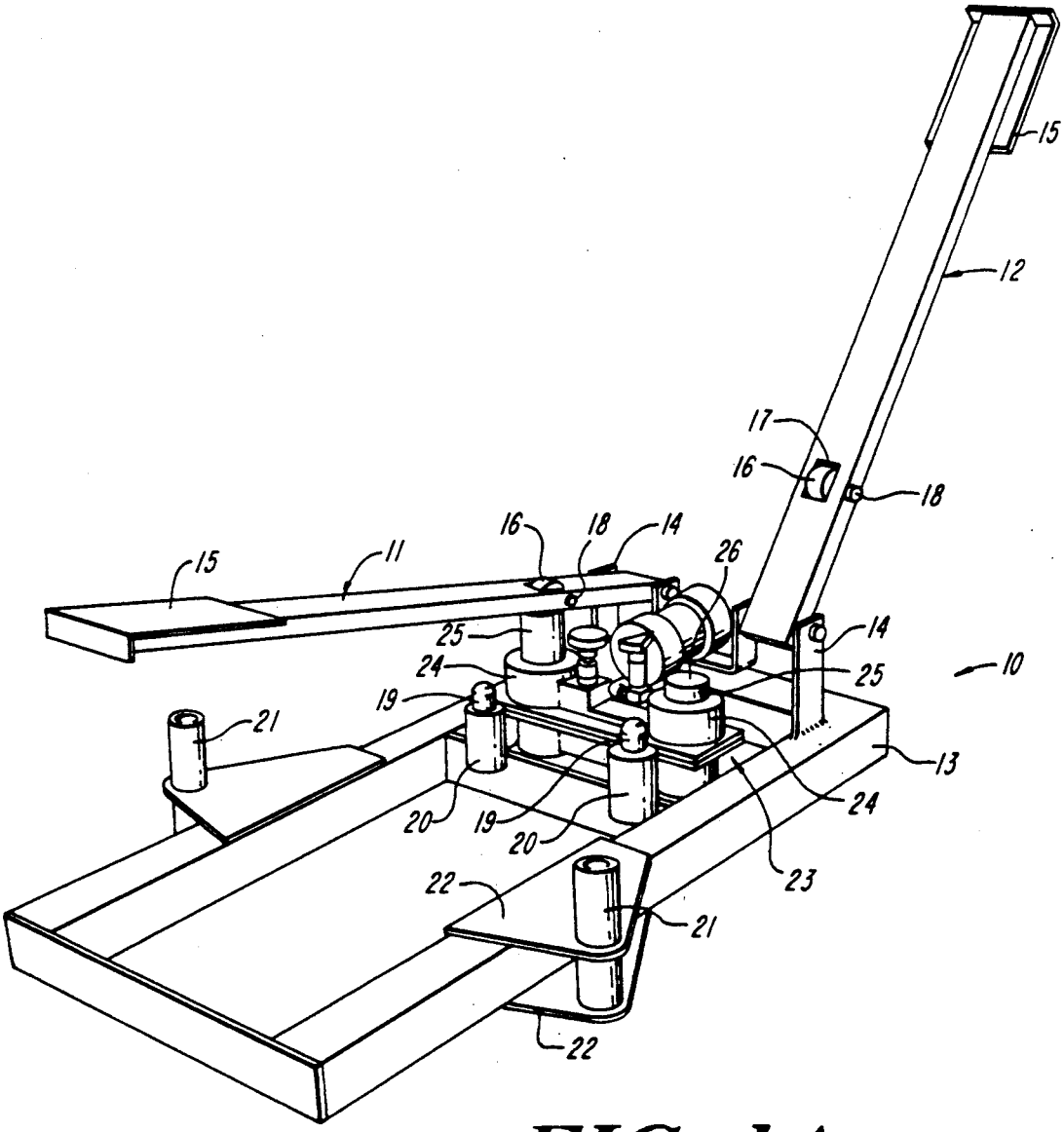
FIGS. 1A and 1B illustrate in isometric view the unitary hydraulic casting structure and its use in pivoted-arm stair-climbing exercise apparatus, also showing roller contact between the tops of the rams and the bottoms of respective pivoted arms.

Referring now to FIG. 1A, a stair step type pivotted arm exercise device 10 is illustrated. While the subject invention will be described in terms of pivoted arm machines, the unitized hydraulic control system is applicable to other types of stair climber machines, including those with steps mounted on inclined tracks. As to pivoted arm machines, device 10 is shown with arms 11 and 12 pivotally mounted to a frame 13 at supports 14, with each of the arms 11 and 12 having foot engaging pads 15 thereon. Each of the arms is provided with a roller 16 which projects through an aperture 17 in the arm and is mounted for rotation around a bolt 18 as illustrated. In the down position the arms are limited in their downward movement by shock cushions 19, which in one embodiment includes a cylindrical mass of spongey, rubbery material held within a cylinder 20. The frame has a hand rail receiving cylinder 21 mounted through flanges 22 to frame 13.

The phasing of the arms is accomplished through a unitary structure 23 which includes two integral ram receiving cylinders 24 from which rams 25 project as illustrated. The tops 26 of the rams coact with rollers 16, such that when an individual is in place on the exercise device the rams control the rate of exercise by controlling the position of the pivoted arms.

Figure 1B:
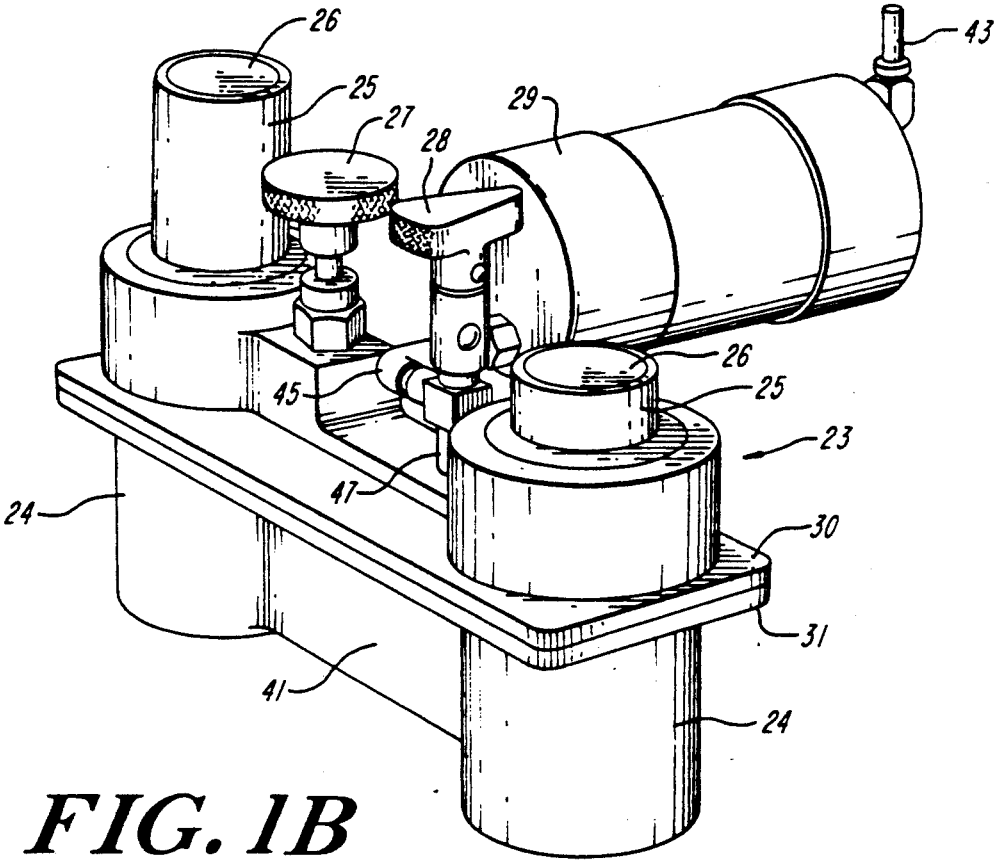

As will be discussed, and as shown in FIG. 1B the rate of exercise is controlled by a valve 27, whereas the step height is controlled by a valve 28 interposed between an auxiliary cylinder 29 and the unitary housing which is made up of two unitary castings 30 and 31.

It is through the utilization of this unitary casting structure and by virtue of the fact that there is rolling or slipping contact made between the tops of the pistons and the respective arms that a simplified hydraulic phasing system can be utilized not only to phase the stair steps but also to provide for step height adjustment or, alternatively, for the complete collapse of both the arms down to the aforementioned shock absorbing cushions so that the whole structure can be slid under a bed or stored in a closet. What will be seen is that because there is rolling contact between the tops of the rams there need be no flexible mounting of the ram cylinders to the frame as the arms pivot. Flexible mounting and flexible cylinder inter connections were necessary when either piston rods or rams are mechanically linked to the respective as is the case in prior art devices. Prior flexible mounting has made the control of stair climbing type exercise apparatus prohibitively expensive both in terms of the cost of the phasing apparatus and also in terms of the parts count. It will be appreciated that the higher the parts count the higher will be the incidence of failure as there are more parts to fail.

As can be seen the two unitary castings are formed such that they have integral cylinders 24 disposed therein, with the lower casting 31 having a fin or web 41 between the opposed cylinders 24. The purpose of this web is to provide a cooling fin for the apparatus. It will be appreciated that when energy is exerted during exercise, the energy must be dissipated in some convenient manner. Rather than having a traditional heat exchanger in the form of a conventional radiator, the heat exchange element is integral with the lower casting.

In operation, the auxiliary cylinder 29 is filled with fluid for the system, namely oil, through the utilization of fluid under pressure through nipple 43. It will be appreciated that this fluid flows out of the auxiliary cylinder through a conduit 45 to valve 28 and then through another conduit 47 which communicates with the top casting. This provides the working fluid for the system and, if both of the arms of the exercise device in FIG. 1A are initially in their down position, opening of valve 28 permits the forcing of fluid into the system which causes rams 25 to rise. Appropriately positioning the rams through the individual stepping on one and partially stepping on the other to initially set the step height permits locking in of this step height by closing valve 28 which essentially fixes the amount of fluid in the system. In one embodiment, oil or other working fluid is forced from auxiliary cylinder 29 into cylinders 24 through air pressure which exists above the oil in the auxiliary cylinder.

The rate at which the fluid is permitted to pass from one cylinder to the other cylinder is controlled through a rate valve 27 such that the more open the valve 27, the easier it is for fluid to flow from one cylinder to the other and therefore the more rapid the exercise rate in terms of the amount of steps that an individual can take in a given period of time. Closing valve 27 limits the fluid flow from one cylinder to the other. This decreases the number of steps per minute that an individual can take. Thus the setting of valve 27 sets the exercise rate and thus the level of exercise or the exercise intensity.

Should oil need to be replenished in the system, for instance due to leakage, valve 28 is opened slightly and the make-up oil is introduced to the system. Likewise, when it is required for the arms of the exercise apparatus to be collapsed down to the frame, valve 28 is opened and the individual stands on the arms thereby forcing the fluid back into the auxiliary cylinder; at which point valve 28 is clamped shut. This provides a convenient way of permitting storage of the exercise apparatus such that the exercise apparatus can be designed for home use. It will be appreciated that during use, the rams reciprocate in their respective cylinders with the unitary structure being fixedly attached to the frame. No flexible mounting system is required for either of the two cylinders due to the fact of the rolling contact of the tops of the rams with the respective rollers or other apparatus on the underneath side of each of the arms.

What is therefore provided is a simple unitary phasing assembly for pivoted arm stairstep apparatus which minimizes the parts count, reduces leakage and other failure modes for such apparatus, and provides for a ram type system that easy step height adjustability that one can obtain in a piston type system, albeit with an order of magnitude more parts for the system.

By way of background and referring now to FIG. 2A, a typical prior art two-step pivoted lever arm stair climbing-type exercise device is illustrated by reference character 32 to include pivoted step carrying levers or arms 33, with the pivot point being at 34 as illustrated. The phasing or relative position of the stair steps is controlled in general by a hydraulic control system 35, with the rate of exercise being controlled by a valve 36 located between two hydraulic cylinders 37. Here each cylinder has a ram 38 pivotally connected to a respective arm 33 such that during exercise, respective rams and cylinders must move as illustrated by arrows 39. This movement is usually accommodated by flexible mounting and coupling of the cylinders to a frame or base of the exercise machine. Note these cylinders are connected to valve 36 via conduits 40. The exercise device is provided with a handrail 42 and exercise rate control electronics 44. As illustrated, each of the pivoted arms has an associated step 45 and 46.

Figure 2A:
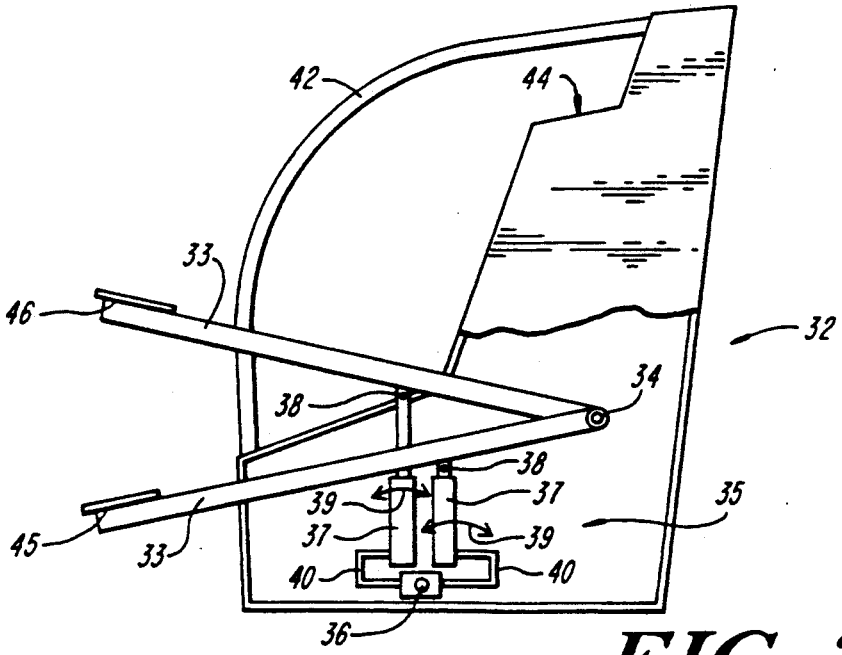
FIG. 2A (PRIOR ART)
FIG. 2A is a diagrammatic representation of a prior art two-step pivoted arm exercise machine with a hydraulic step phasing arrangement.
Figure 2B:
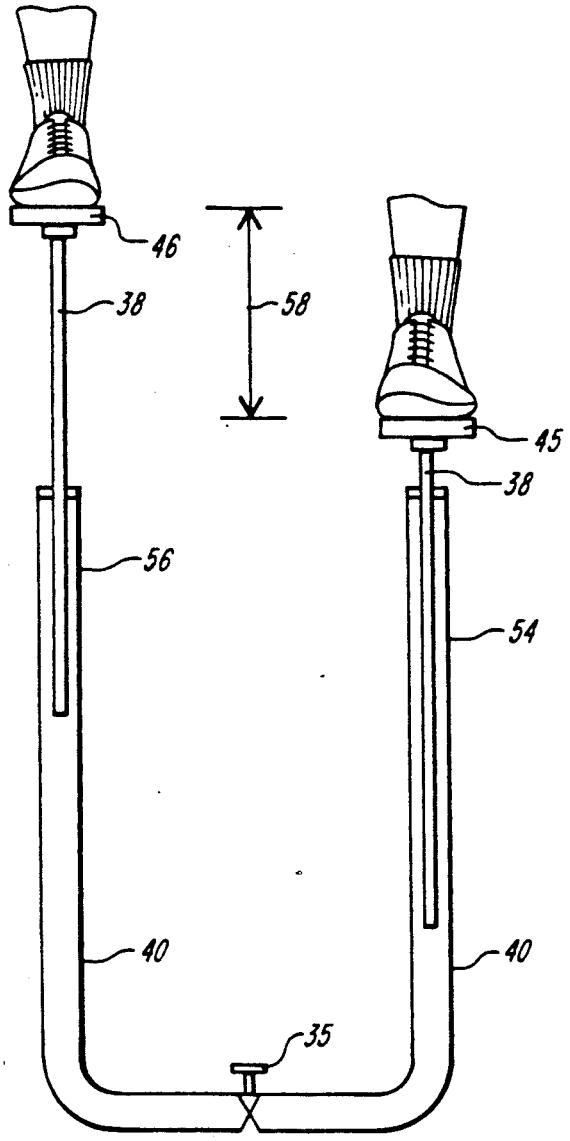
FIG. 2B is a diagrammatic representation of the step phasing arrangement for the exercise device of FIG. 1A.

Referring to FIG. 2B, the exercise device of FIG. 2A is illustrated insofar as the steps 45 and 46 are shown to be connected to rams 38 which are disposed in respective cylinders 54 and 56 which are interconnected as by conduits 40 to valve 35.

In operation, the relative motion of the stair steps is controlled by the passage of fluid from one hydraulic cylinder to the other through valve 35 which controls the rate of flow of the fluid. The rate of flow of fluid controls the exercise rate, with more fluid flow resulting in more rapid exercise. One of the problems with such a ram-type system as mentioned hereinbefore is the inability to be able to adequately adjust step height 58.

Figure 2C:
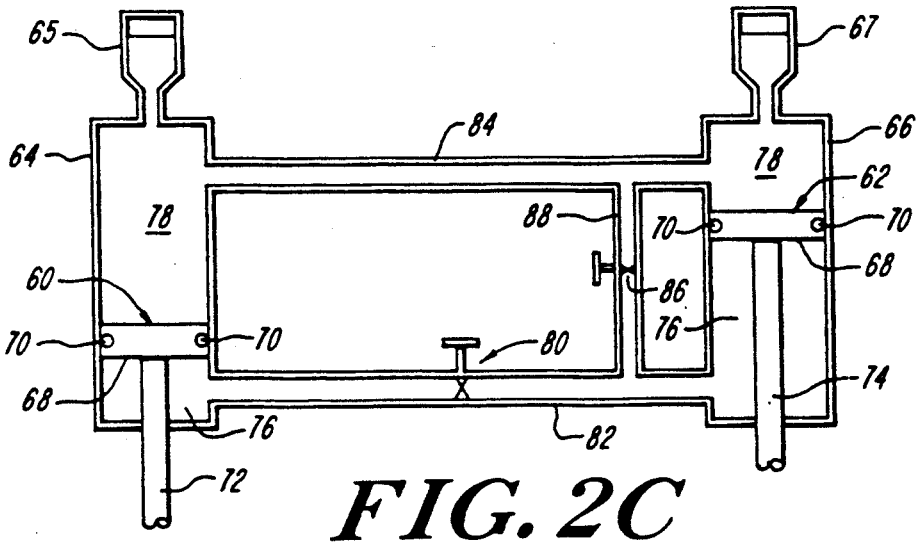
FIG. 2C (PRIOR ART)
FIG. 2C is a diagrammatic representation of a prior art step phasing arrangement for use with piston cylinder-controlled exercise devices.

While the system illustrated in FIG. 2B is a hydraulic ram cylinder-type system, a piston system can be provided with step height control. This prior art system is shown in FIG. 2C and involves the utilization of pistons 60 and 62 which are disposed in chambers 64 and 66 respectively having accumulators 65 and 67 thereabove to add or subtract fluid to the cylinders of the system on a cycle by cycle basis for the transient needs of above-piston fluid flow and to accommodate thermal expansion. It will be appreciated that the piston includes a piston head 68 and seals 70 as illustrated.

The use of a sealed piston head which rests on respective rods 72 and 74 divides the respective chambers in two, so as to provide a lower chamber 76 and an upper chamber 78. As in the earlier-mentioned control system, the rate of exercise is controlled by a valve 80 in a conduit 82 running between chambers 76 of the respective pistons. While valve 80 controls the rate of exercise, step height adjustment is provided in this prior art device through the utilization of an interconnecting conduit 84 between the respective chambers 78 and by the utilization of a bypass valve 86 in a conduit 88 which runs between conduit 84 and conduit 82.

By bleeding off a certain amount of fluid from chambers 78 to chambers 76, it will be appreciated that the amount of fluid in the system can be varied, which varies the amount of step height between a lower and upper step.

Figure 2D:
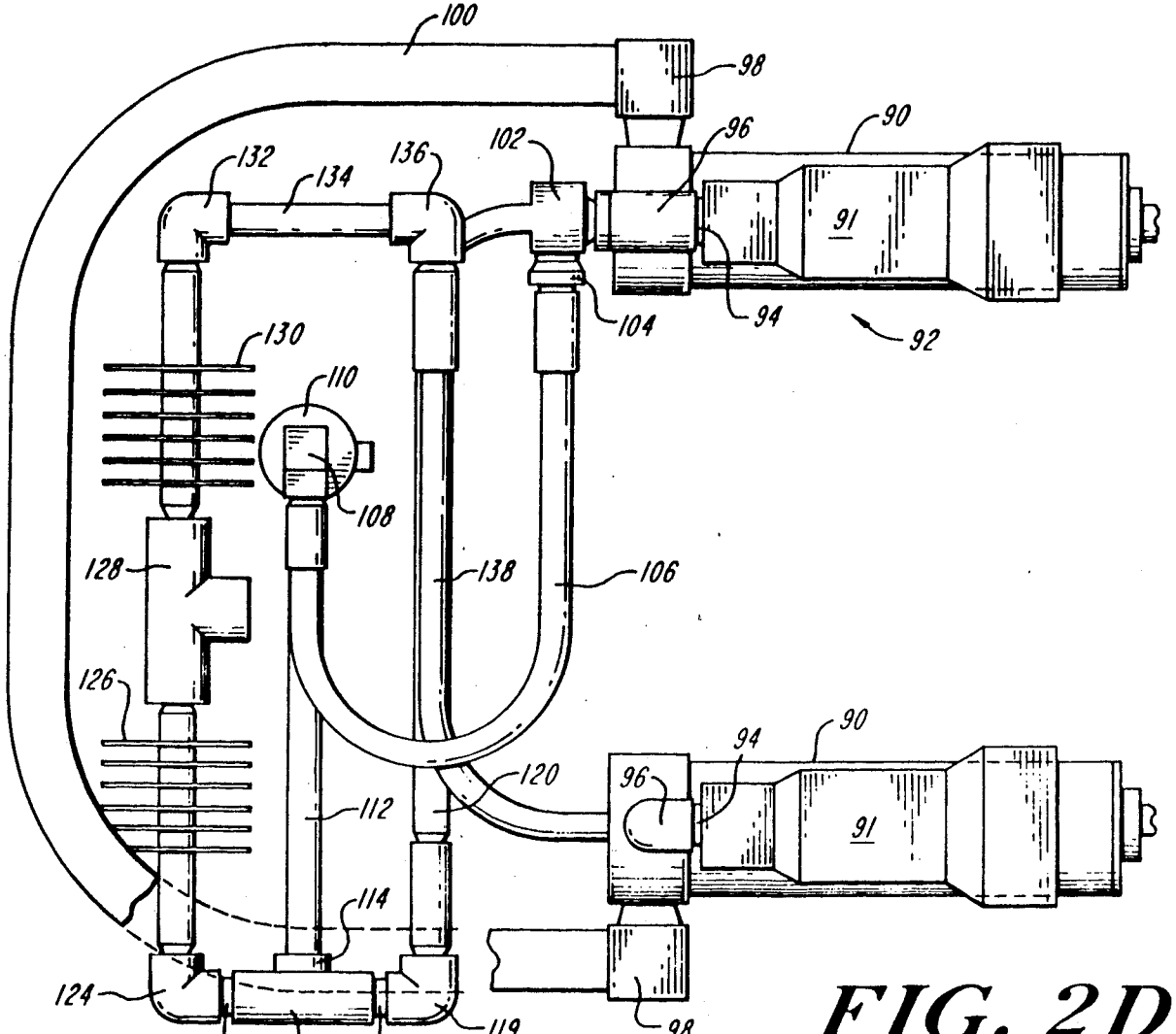
FIG. 2D (PRIOR ART)
FIG. 2D is a schematic diagram and top view, illustrating the number of parts necessary in a prior art step phasing system.

While the piston control system depicted in FIG. 2C results in an exceptionally accurate control of step height and of the fluid in the system, the implementation of such a system, as illustrated in FIG. 2D, requires a great many parts.

As illustrated in FIG. 2D, the two piston-receiving cylinders 90 are coupled to accumulators 91 via a brazed fitting 92 through an accumulator close nipple 94 to an accumulator TEE 96. This TEE is in turn coupled to an accumulator swivel adapter 98 to an accumulator hose assembly 100. The upper accumulator TEE is connected to a bypass swivel adapter 102 which is in turn coupled by a bypass accumulator bushing 104 via a bypass hose assembly 106 to a bypass F-F EL 108, which is in turn coupled to a bypass ball valve 110. The output of this ball valve is coupled by a bypass long nipple 112 through a bypass F-F EL 114 which is in turn coupled to a rate TEE 116. This rate TEE is coupled at one end to a rate close couple nipple 118 which couples fluid to and from the rate TEE 116 to a hose assembly 120 which is coupled back to the below-piston inlet of one cylinder 90.

A rate close nipple 122 is coupled to a rate reducing EL 124 which is in turn coupled through heat dissipating fins on a cooling nipple assembly 126. This cooling nipple assembly is coupled to a rate needle valve 128 which is in turn coupled to a cooling nipple assembly 130, in turn coupled to a rate reducing EL 132 and through a rate long nipple 134 to a rate F-F EL 136 which is in turn coupled to a hose assembly 138 that is coupled to the below-piston inlet of the second cylinder 90.

What will be seen is that there are a large number of individual elements necessary for the implementation of the FIG. 2C system.

Figure 2E:
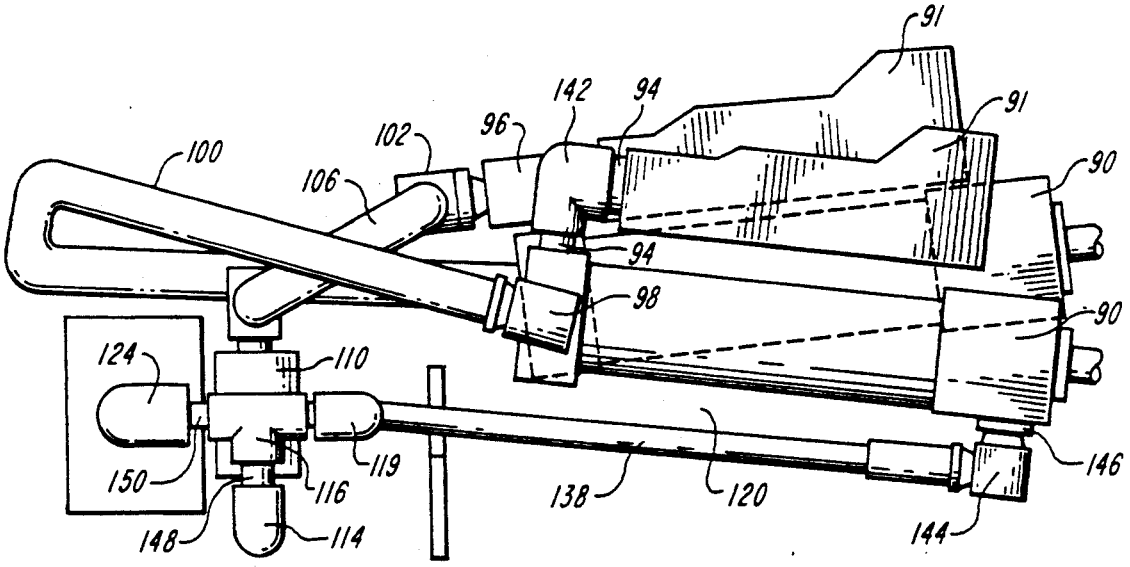
FIG. 2E is a schematic diagram and side view of the step phasing system of FIG. 2D.

This is also illustrated in FIG. 2E in which like reference characters are used between the individual elements of FIGS. 2D and 2E. Here, however, the piston cylinders 90 are clearly visible as being connected by the accumulator close nipple 94 to accumulator EL 142 to accumulator 91. Likewise, accumulator swivel adapter 98 is coupled to the accumulator hose assembly 100 with the bypass hose assembly 106 being coupled to the bypass swivel adapter 102 which is in turn coupled to the accumulator TEE 96 associated with the other accumulator. Note the position of a rate hose assembly 138 as being positioned between rate swivel adapter 144 which is coupled to the below-piston chamber through cylinder-reducing bushing 146. The other end of the rate hose assembly 120 is coupled to a rate F-F EL 119 which is in turn coupled to rate TEE 116, coupled to bypass F-F EL 114 via a bypass close nipple 148. The rate TEE 116 is shown coupled to bypass ball valve 110 as illustrated and, to the cooling nipple assembly 126 via rate reducing EL 132 and bypass close nipple 150. Note that cylinders 90 move in relation to each other during exercise due to opposing motion of legs of the user of the device.

Figure 3:
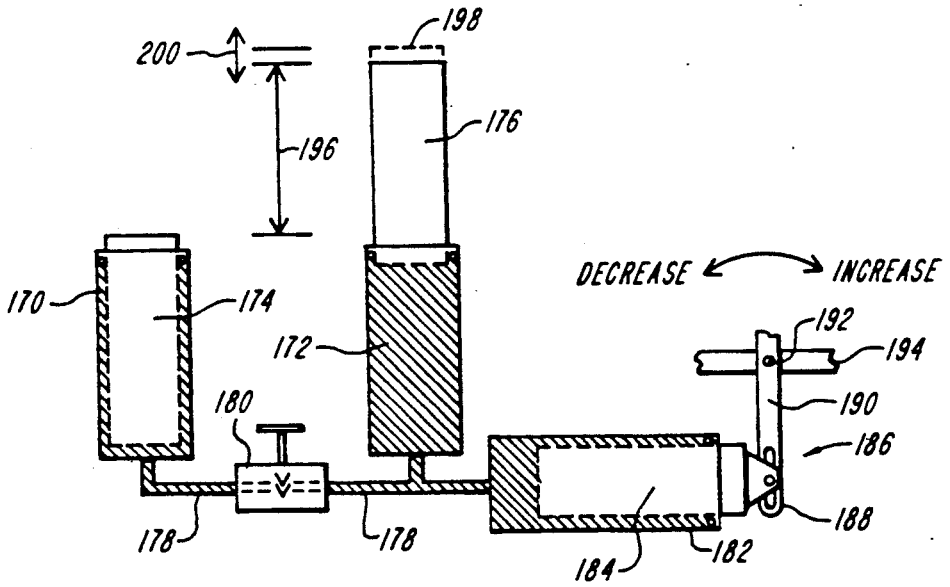
FIGS. 3 is a diagrammatic illustration of a control system for ram cylinder applications, indicating use of an auxiliary cylinder and rate valve system used for adjusting step height and phasing in which fluid volume alterations are accomplished mechanically and, FIG. 4 is a diagrammatic illustration of a modification to the control system of FIG. 3 in which the auxiliary chamber is provided with a pressurizing gas and wherein a fluid volume valve is interposed between the main hydraulic circuit and the auxiliary cylinder; and, FIG. 5 is a cross sectional and diagrammatic view of the subject unitary casting for implementing the control system of FIG. 4 with a minimum of parts.

Referring now to FIG. 3, rather than the complicated system utilized for piston cylinder control systems, a system for stair step phasing and step height adjustment for ram cylinder arrangements is illustrated in which two ram cylinders 170 and 172 have respective rams 174 and 176 disposed therein. These ram cylinders are interconnected via a conduit 178 through a rate control valve 180 which operates very similarly to the system illustrated in FIG. 2B. In order to adjust step height, an auxiliary cylinder 182 is provided with an internal ram 184 which adds or subtracts fluid in the system by virtue of movement of the ram 184 in and out of cylinder 182 via the apparatus shown by reference character 186 to include a coupling 188 and a lever 190 which is pivoted at 192 against a member 194 such that movement of the lever moves ram 184 in and out of cylinder 182 to either increase or decrease the step height illustrated by arrow 186. This system also permits adjustment of fluid to accommodate fluid expansion, which expansion results in the raising of one ram as illustrated at dotted line 198 and thus results in a step height difference illustrated by arrow 200.

Figure 4:
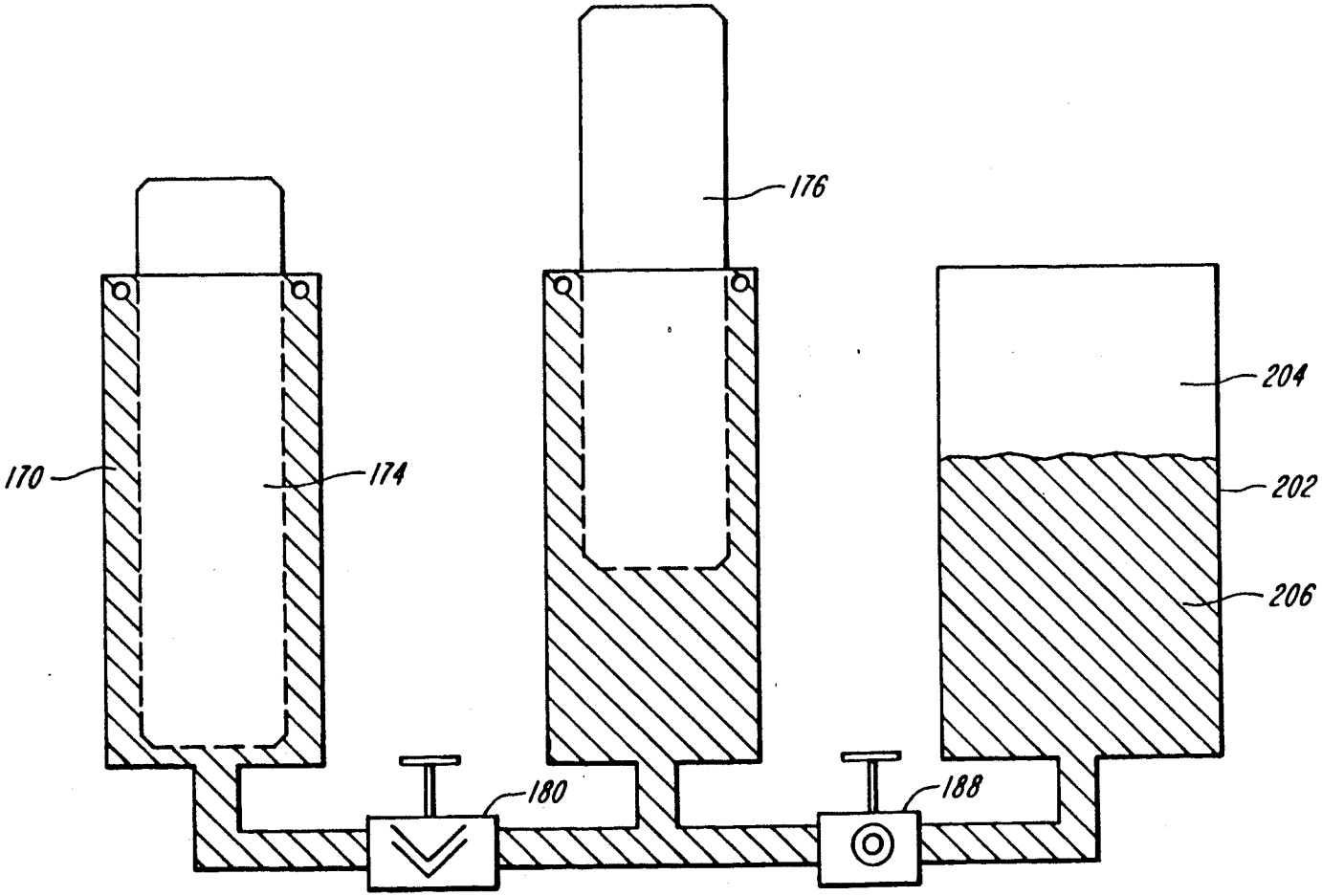

Referring now to FIG. 4 in which like elements have like reference characters as between FIGS. 3 and 4, the manual adjustment system is replaced with a pressurized fluid adjustment in which the auxiliary chamber 202 is provided with air or other gas under pressure here shown at 204. A valve 188 is initially in an off condition until such time as additional fluid is to be admitted into the system. At this time, valve 188 is opened and air pressure forces fluid 206 into the hydraulic circuit made up of the respective rams and their associated cylinders. When sufficient fluid is added to the system, valve 188 is shut off. Alternatively, when fluid is to be withdrawn from the system, pressure is put on one or the other of rams 174 or 176 so as to recompress the air or gas 204 in auxiliary cylinder 202. After the desired amount of fluid is removed from the system, valve 188 is closed.

It will be appreciated that the relative positions of the rams and thus the steps may be adjusted in this manner without the necessity of providing for a mechanically actuated ram in the auxiliary cylinder. As will be appreciated the stair steps can be completely dropped by depressing the rams and withdrawing the necessary fluid into the auxiliary cylinder. Alternatively the relative heights of the rams and thus the associated steps can be adjusted through the admitting of additional fluid into the circuit between the two cylinders.

Figure 5:
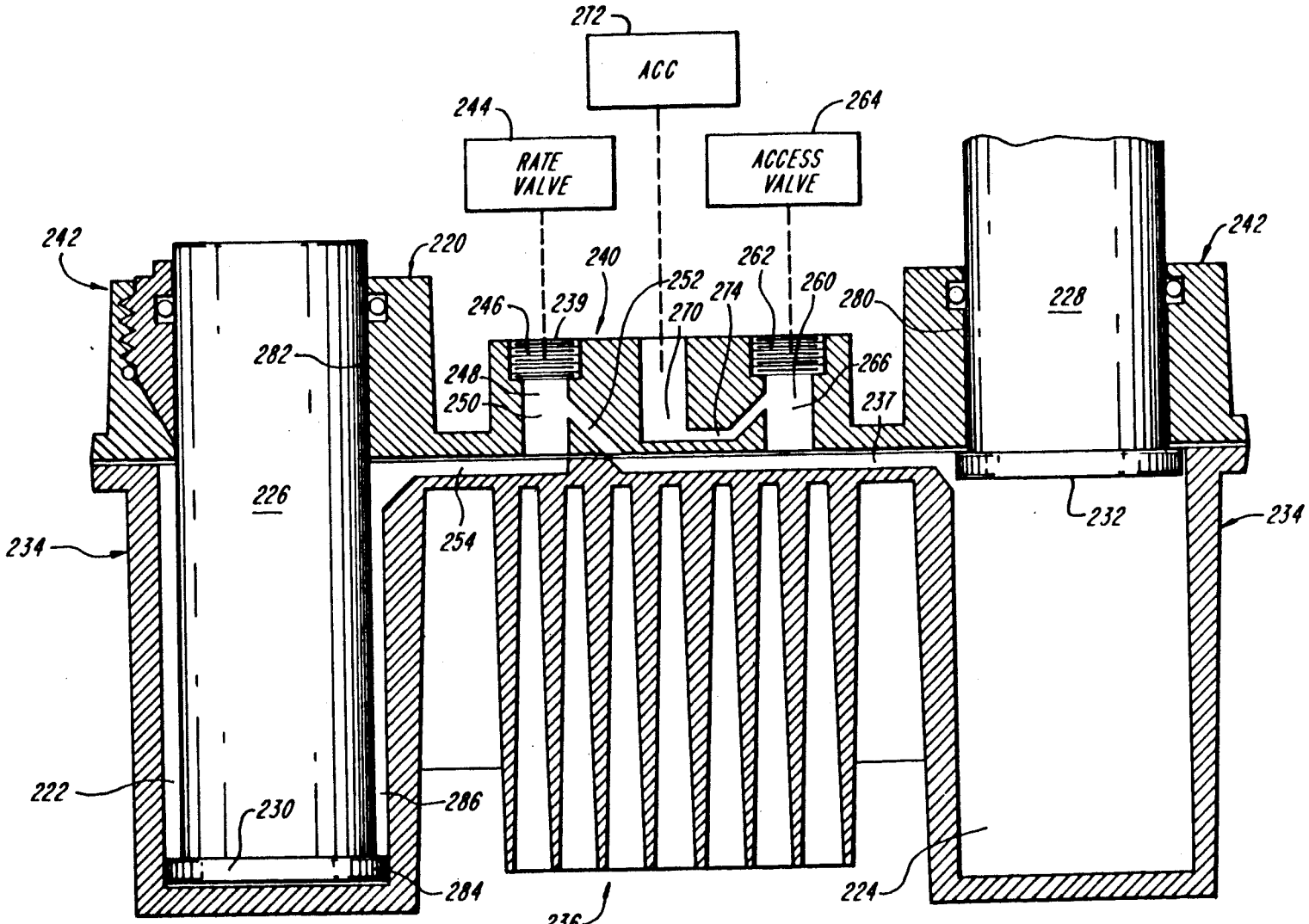

In contradistinction to the amount of apparatus necessary to implement a piston cylinder system as illustrated in FIGS. 2D and 2E, and referring now to FIG. 5, it will be appreciated that in order to implement step height adjustment in a ram system, it has been found that the FIG. 4 system can be implemented by a unitary two part casting 220 that uniquely provides a large portion of the hardware necessary. The bottom casting includes respective ram-receiving chambers 222 and 224, with the rams 226 and 228 being provided with enlarged faces or end pieces 230 and 232 respectively.

In this figure, the unitary housing is in two sections with the lower casting 234 having integral fins 236 disposed therefrom between chambers 222 and 224. While numbers of fins are desirable for maximum heat dissipation, it has been found that a single transverse web between the cylinders as shown in FIG. 1B can dissipate sufficient heat. Referring back now to FIG. 5, note chambers 222 and 224 are connected via an internal conduit 237 to a rate valve port 239 in the top casting 242. This top casting includes a central portion 240 which is bored and tapped so as to accommodate a rate valve 244 into a threaded portion 246 of an aperture 248 in central portion 240. Aperture 248 defines a channel 250 which communicates with channel 237 via a slanted channel 252. Channel 250 communicates with a channel 254 which in turn communicates with chamber 222 as illustrated.

Central portion 240 also includes an aperture 260 which includes a threaded portion 262 to which is attached a fluid volume valve 264, with aperture 260 defining a channel 266 that communicates both with channel 237 and with an aperture 270 to which an an auxiliary cylinder 272 is coupled. The communication between channel 266 and aperture 270 is via a channel 274 in central portion 240 of the upper portion 242 of the unitary casting.

It will be appreciated that the top and bottom castings of the unitary casting may be clamped and sealed together in a conventional fashion. Moreover, rams 226 and 228 may be sealed to respective channels 280 and 282 in upper unitary housing portion 242 in any convenient manner.

It will also be appreciated that the widened face or end portions 230 and 232 associated with each of the pistons can be configured so as to prevent rotation or canting of a piston in the respective chamber due to the cooperation of the edges 284 with an interior wall 286 of the associated ram-receiving chamber. This adds to the overall stability of the system.

What will be appreciated is that the unitary structure is a two-part housing made from castings, with all of the necessary structures being provided within the housing so as to eliminate the excessively high parts count associated with the bypass piston cylinder control system discussed previously.

The unitary casting structure is permitted due to the aforementioned utilization of a moving point of contact between the tops of the rams and the articulated, reciprocating or pivoted arms of the exercise machine. As mentioned hereinbefore, if these arms were to be pivotally attached to the tops of the rams, then the entire structure would have to be pivotally mounted or flexibly mounted to accommodate the changes in position of the rams as the stairs are moved up and down in a pivoted manner.

Because of the utilization of the roller contact with the tops of the rams, it is now possible to provide the ram cylinders in a fixed position relative to the frame of the exercise apparatus. This makes possible the provision of a unitized structure having fixed cylinders. As an alternative to the roller bearing cooperation and communication with the tops of the rams, it is possible to provide a suitably flexible coupling of the tops of the rams to the stair arms, should such be desired.

Having above indicated a preferred embodiment of the present invention, it will occur to those skilled in the art that modifications and alternatives can be practiced within the spirit of the invention. It is accordingly intended to define the scope of the invention only as indicated in the following claims:

I claim:

1. Apparatus for control of dual cylinder hydraulic exercise equipment, comprising:

a pair of rigidly connected cylinders each having a reciprocating member therein, with each reciprocating member having a longitudinal axis, and with the top portion of each reciprocating member being exposed outside of its respective cylinder, each of said reciprocating members having means at the top thereof adapted to be contacted by a moveable member for permitting slipping or rolling motion therebetween in a direction transverse to said longitudinal axis while said moveable member is depressing the reciprocating member into its respective cylinder;

a pair of moveable members each having a contact portion adapted to be moved responsive to exercise in a direction to depress an associated reciprocating member into its cylinder;

said pair of moveable members each adapted to coact with the top portion of a respective reciprocating member at said contact portion, and each member including means for permitting a slipping or rolling motion of said contact portion relative to the exposed top portion of a respective reciprocating member in a direction transverse to the longitudinal axis thereof, whereby no substantial side forces are applied to said top portions when said moveable members act on respective reciprocating members to depress them into respective cylinders; and, means for fluidically interconnecting said cylinders.

2. The apparatus of claim 1 wherein said equipment has a base which supports said equipment and wherein said rigidly connected cylinders are themselves rigidly mounted to said equipment base.

3. The apparatus of claim 2 wherein said exercise forces compress the reciprocating members in respective cylinders.

4. Apparatus for control of exercise equipment, comprising:

a pair of reciprocating members adapted to move in opposite directions under fluidic control and adpated to be connected to said exercise equipment for the control thereof, each of said reciprocating members having a longitudinal axis, with a top portion of each reciprocating member being exposed outside its respective cylinder, each of said reciprocating members having means at the top thereof adapted to be contacted by a moveable member for permitting slipping or rolling motion therebetween in a direction transverse to said longitudinal axis while said moveable member is depressing the reciprocating member into its respective cylinder;

a unitized assembly for fluidic control of said pair of reciprocating members, said assembly including a top and a bottom casting, a corresponding pair of spaced and apart reciprocating member receiving chambers forming cylinders in said bottom casting such that they are rigidly connected, a rate setting valve orifice in said top casting, fluid channels between each of said cylinders and said rate setting valve orifice, an auxiliary chamber orifice in said top casting and a fluid channel between said auxiliary chamber orifice and both of said cylinders;

a rate valve coupled to said rate valve orifice;

an auxiliary chamber coupled to said auxiliary chamber orifice; and, a pair of moveable members each having a contact portion adapted to be moved responsive to exercise in a direction to depress an associated reciprocating member into its cylinder;

said pair of moveable members each adapted to coact with the top portion of a respective reciprocating member at said contact portion, and each member including means for permitting a slipping or rolling motion of said contact portion relative to the exposed top portion of a respective reciprocating member in a direction transverse to the longitudinal axis thereof, whereby no substantial side forces are applied to said top portions when said moveable members act on respective reciprocating members to depress them into respective cylinders.

5. The apparatus of claim 4 wherein each of said reciprocating members includes a ram.

6. The apparatus of claim 4 and further including a fluid volume valve interposed between said auxiliary chamber and said auxiliary chamber orifice.

7. The apparatus of claim 4 wherein said exercise equipment includes a pair of moveable arms having a surface adapted to respectively contact the tops of said reciprocating members and means between an arm and an associated reciprocating member top for permitting frictionless contact therebetween.

8. The apparatus of claim 7 wherein said frictionless contact means includes a roller.

9. The apparatus of claim 8 wherein said roller is cylindrical.

10. The apparatus of claim 4 and further including integral heat dissipating means between said cylinders.

11. The apparatus of claim 10 wherein said integral heat dissipating means includes a rib.

12. The apparatus of claim 11 wherein said cylinders have parallel longitudinal axes, and wherein said rib includes a flat surface in a plane parallel to the longitudinal axes of said cylinders.

13. Apparatus for control of dual cylinder hydraulic exercise equipment, comprising:

a pair of rigidly connected cylinders each having a reciprocating member therein, with each reciprocating member having a longitudinal axis, and with the top portion of each reciprocating member being exposed outside of its respective cylinder, each of said reciprocating members having means at the top thereof adapted to be contacted by a moveable member for permitting slipping or rolling motion therebetween in a direction transverse to said longitudinal axis while said moveable member is depressing the reciprocating member into its respective cylinder;

a pair of moveable members each having a contact portion adapted to be moved responsive to exercise in a direction to depress an associated reciprocating member into its cylinder;

said pair of moveable members each adapted to coact with the top portion of a respective reciprocating member at said contact portion, and each member including means for permitting a slipping or rolling motion of said contact portion relative to the exposed top portion of a respective reciprocating member in a direction transverse to the longitudinal axis thereof, whereby no substantial side forces are applied to said top portions when said moveable members act on respective reciprocating members to depress them into respective cylinders.

14. The system of claim 13 wherein said fluid in compression is compressed by gaseous means within said auxiliary chamber acting on a surface of said fluid.

15. The system of claim 13 wherein said fluid in compression is compressed by mechanical means.

16. The system of claim 15 wherein said mechanical means includes a user-operated plunger in said auxiliary cylinder.

* * * * *